US007986803B1

(12) United States Patent
DeKalb

(10) Patent No.: US 7,986,803 B1
(45) Date of Patent: Jul. 26, 2011

(54) EAR BUD SPEAKER EARPHONE WITH RETAINER TAB

(75) Inventor: Frederick P DeKalb, Ben Lomond, CA (US)

(73) Assignee: Plantronics, Inc., Santa Cruz, CA (US)

( * ) Notice: Subject to any disclaimer, the term of this patent is extended or adjusted under 35 U.S.C. 154(b) by 1111 days.

(21) Appl. No.: 11/801,589

(22) Filed: May 10, 2007

(51) Int. Cl.
*H04R 25/00* (2006.01)

(52) U.S. Cl. ..... 381/380; 381/328

(58) Field of Classification Search ..... 381/380, 381/375, 370, 379, 322; 181/129, 130, 135
See application file for complete search history.

(56) References Cited

U.S. PATENT DOCUMENTS

| | | | | |
|---|---|---|---|---|
| 3,041,856 | A * | 7/1962 | Neal | 63/14.1 |
| 5,712,453 | A | 1/1998 | Bungardt et al. | |
| 5,748,743 | A * | 5/1998 | Weeks | 381/328 |
| 6,810,987 | B1 * | 11/2004 | DeKalb | 181/129 |
| 6,819,762 | B2 | 11/2004 | Jones et al. | |
| 2002/0131585 | A1 | 9/2002 | Jones et al. | |
| 2003/0174853 | A1 | 9/2003 | Howes et al. | |
| 2005/0111686 | A1 * | 5/2005 | Bayer | 381/330 |
| 2008/0137897 | A1 * | 6/2008 | Liu | 381/380 |
| 2008/0144877 | A1 | 6/2008 | Ham et al. | |

FOREIGN PATENT DOCUMENTS

| | | | |
|---|---|---|---|
| JP | 2000165972 | A1 | 6/2000 |
| WO | WO03075608 | A1 | 9/2003 |

* cited by examiner

*Primary Examiner* — Davetta Goins
*Assistant Examiner* — Phan Le
(74) *Attorney, Agent, or Firm* — Richard Goldman; Michael Rodriguez

(57) ABSTRACT

An ear bud earphone having an outer portion, which may be a microphone or sound input or a contact for wires or acoustic tubes, a central body portion, an ear canal main body and a tab. The ear canal main body of the earphone has flexibility to conform to the ear anatomy. The ear (pinna) has a helix, an anti-helix, a concha including the anatomical elements of a cymba and a cavum, and an ear canal. The ear canal main body is partially inserted into the concha and ear canal opening, with the tab resting on or under the anti-helix.

17 Claims, 3 Drawing Sheets

EAR BUD SPEAKER EARPHONE WITH RETAINER TAB

BACKGROUND

1. Field of the Invention

The invention relates to ear bud earphones and speakers, including headphones, and headsets, especially for mobile and hands free operation, and for the retention of the headphones, headsets, and earphones during physical activity and movement by the user. In one embodiment the subject earphones have a system, structure, or process for converting an information signal from audible acoustic sound vibrations to corresponding time-varying electrical quantities. The earphone is intended to be placed in or over the user's ear canal, that is, sealably within the concha or ear canal. This serves to acoustically isolate the ear canal from a noisy environment. This is to provide for a high degree of miniaturization and unobtrusiveness with a minimum amount of amplification, and associated noise and distortion. Included are earphones where a small sound reproducing system, that is, an output transducer, transmits signals directly into the ear canal to increase the sound level received by the ear. Signals may be electromagnetic signals conveyed to the earphones by conductors, electromagnetic signals conveyed to the earphone without the use of conductors, such as by modulated RF or infrared carrier, and acoustic signals conveyed to the earphones by tube or conduit.

2. Background Art

Sound devices such as earphones and headphones are used extensively throughout the world. One style of earphone that is commonly used is referred to as an ear bud or an ear bud-type headphone. Ear buds are small speaker-like devices that are designed to fit within the external ear, that is, the concha or ear canal, of a user so that the user can listen to sound being transmitted from a sound source with a degree of acoustic isolation from environmental sound pollution. Some examples of typical sound sources where ear buds may be used include personal and/or portable audio players (including radios, cassette players, compact disc players, portable mp3 players, etc.), portable DVD players, telephones (including wireless and cellular type telephones), two way radios, etc. When properly positioned in the ear, ear buds can provide the listener with acceptable sound transmission to the ear canal. However, due to person-to-person variations and variations in the environment in which the ear buds are used, fit may not be adequate and extraneous noise may make transmission inadequate. In addition, improper fit can greatly degrade the sound quality (level and frequency response). This is particularly important when listening to music.

A wide variety of headphones and ear bud earphones have been developed as well as a number of adapters and prostheses attachable to these devices. In addition, a wide variety of methods for manufacturing headphones (including ear buds) and adapters have been developed. Among these known devices and methods, each has certain advantages and disadvantages. There is an ongoing need to provide alternative devices and methods for making these devices which improve sound transmission, isolate extraneous noise and provide improved comfort and fit.

One problem of ear bud speakers and ear insert headsets, e.g., speakers that are supported predominantly or solely by friction in the ear canal, are typically unstable and easily fall out. Some headphones can be retained this way but once a microphone boom is added an additional form of retention is required.

In addition to the problem of holding the earphone in the ear, there is also a problem of keeping good acoustic coupling of the speaker ear tip to the ear canal. Gravity and movement of the user tends to loosen the speaker ear tip and cause it to fall either down into the concha or entirely out of the ear. Keeping good coupling is particularly important if the speaker is using a sealed design.

There are numerous miniature speaker and ear bud products on the market. Many of these ear bud speaker products use ear bud insert type speakers, as ear bud speakers, that are designed to form a seal in the ear. The seal may be effected by, for example, deformation of the ear canal and speaker for a friction seal, and by a pressure differential between the atmosphere and the ear canal as well as by the physical properties of both the ear canal and the ear bud speakers. Most ear bud speakers that attempt to use only friction to hold the headset in place work very poorly. Speakers may also incorporate a microphone boom. The microphone boom only exacerbates the problem of earphone retention.

One application of ear bud earphones is for hearing aids. One of the most persistent and annoying problems facing users of hearing aids is feedback, which is perceived by the user as a high pitched high volume whistling in the ear. While feedback can be a problem with behind-the-ear hearing aids it is particularly prevalent with in-the-ear hearing aids where the microphone and the speaker are in relatively close proximity. Previously this has resulted in a more complicated hearing aid design and increased cost. Various mechanical approaches have also been taken such as ear-molds and hollow cylinder gaskets. Ear-molds must be custom fitted to each user's uniquely shaped ear anatomy, that is the pinna encompassing the helix and anti-helix, and the concha. The need for individually fitting and molding adds to the cost.

Attempts to address this issue with, for example, gaskets and O-rings have not been completely satisfactory. Gaskets and O-rings tend to slide off the end of the hearing aid when the hearing aid is removed from the ear. This tendency is exacerbated by perspiration, ear wax or other lubricants that find their way between the hearing aid and the gasket or O-ring. An O-ring or gasket that slips off can easily get lost or even worse can pose a serious medical problem if it gets trapped or lost inside the ear canal, resulting in a negative esthetic.

Thus, a need exists for a compact ear bud speaker that is readily retained in, and easily removable from, the ear canal.

SUMMARY OF THE INVENTION

The present invention relates to in the ear (typically ear bud earphones) sound devices and adapters and/or prostheses for use with such sound devices. The many problems inherent in ear bud speakers are reduced and even eliminated by the ear bud structure described herein. The primary element is a flexible tab or set of tabs, that is, one or more tabs, made from an elastomeric material or foam protruding from the main body of the headset or headphone, generally opposite the microphone boom and/or cord and at approximately 90 degrees to a longitudinal axis of the ear canal and the ear bud earphone inserted in the ear canal. This tab engages on, under, or against the anti-helix and acts to hold the ear tip against the ear canal entrance to maintain a seal and stabilize any movement of the headset or headphone assembly. The tab is at a slight upward angle (away from the ear tip) so that as it pushes off of the under side of the anti-helix, it exerts a force down and forward on the ear tip. Because the tab is flexible, it easily adjusts to different ear sizes. Multiple tabs can be used with varying lengths to fit an even larger number of ear sizes.

The advantages of this invention over other earphone structures include:

1. Added comfort because the retention force is distributed over more retention area by both friction with and within the concha and by differential air pressure.

2. The use of multiple modes of retention provides greater stability when supporting a headset boom.

3. The ear bud tab and the associated enhancement of friction and pressure retention enhance donning 4. The use of the tab for both ear bud insertion and removal enhances the ability to maintain a seal with the ear canal. This is because the external surface of the tab can be used to apply a gentle insertion force to the ear bud speaker while the opposite surface (the pinna facing surface) may be gently pushed upward and away to remove the ear bud speaker. This avoids the ergonomic and psychological issues associated with inserting and removing objects from bodily openings.

5. The basic structure of the ear bud speaker is simple and compact, especially as compared with an ear hook retainer.

6. An ear hook type of retainer tends to pull the ear tip away from the ear canal opening. This device applies pressure towards it.

DETAILED DESCRIPTION

Structure of the Ear Bud Speaker and Associated Tab

Figure 1:
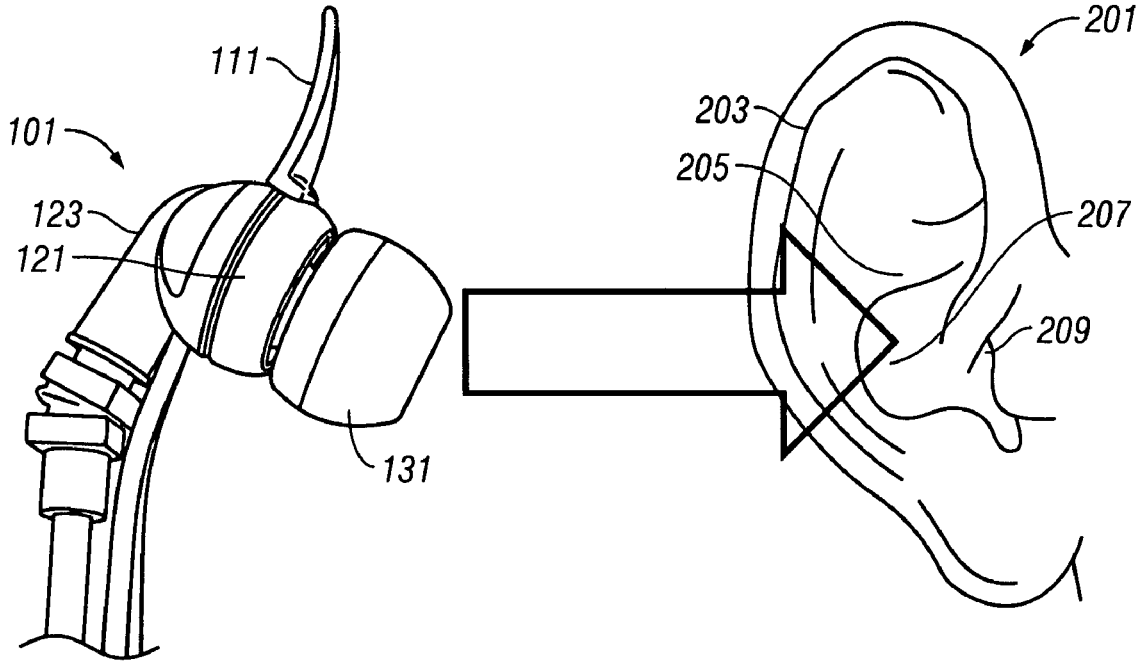
FIG. 1 is an illustration of an ear bud earphone of the invention positioned for insertion in a user's ear.

An ear bud earphone of the invention, positioned for insertion is illustrated in FIG. 1. The earphone 101 is shown with an outer portion 123, which may be a microphone or sound input or a contact for wires or acoustic tubes, a central body portion 121, and an ear canal main body (or ear tip) 131. The ear canal main body 131 of the earphone 101 has flexibility to conform to the ear anatomy. The ear (pinna) 201 has a helix 203, an anti-helix 205, a concha 207 including the anatomical elements of a cymba and a cavum, and the ear canal. The ear canal main body 131 is inserted into the concha 207, with the tab 111 resting under the anti-helix 205.

Figure 2:
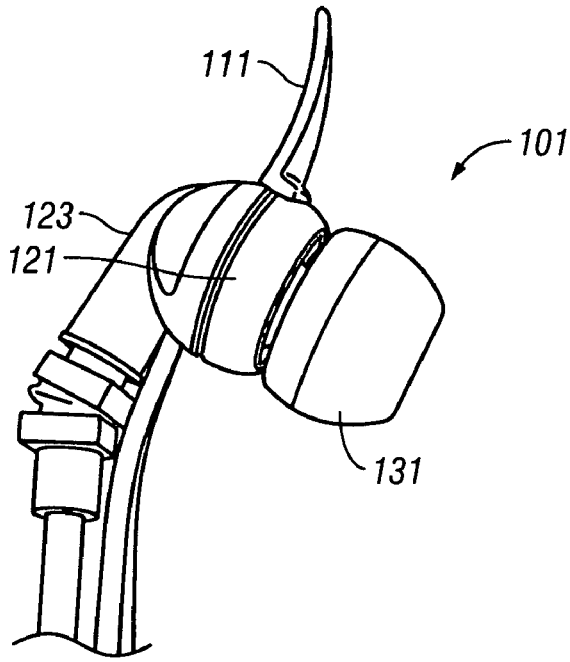
FIG. 2 is an illustration of an ear bud earphone of the invention.

One embodiment of the ear bud earphone of the invention is illustrated in FIG. 2. The earphone 101 as shown in FIG. 2 has an outer portion 123, which may be a microphone or sound input or, alternatively, a contact or input for wires or acoustic tubes, a central body portion 121, and an ear canal main body 131. The ear canal main body 131 of the earphone 101 has flexibility to conform to the ear anatomy.

Figure 5:
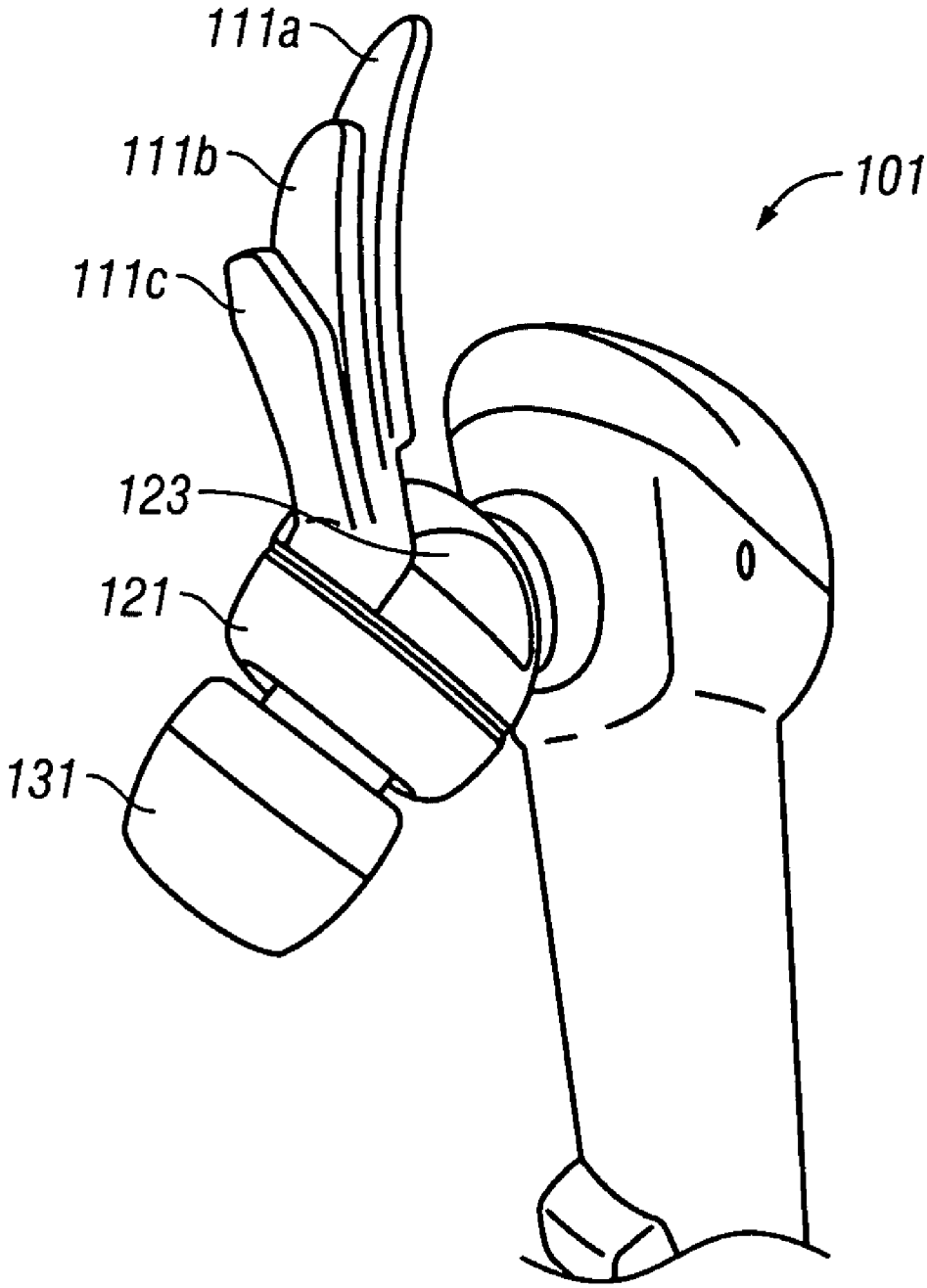
FIG. 5 is an illustration of an alternative ear bud earphone of the invention with a plurality of ear tabs.

An alternative embodiment of the ear bud earphone of the invention is illustrated in FIG. 5. The earphone 101 as shown in FIG. 5 has an outer portion 123, which may be a microphone or sound input or, alternatively, a contact or input for wires or acoustic tubes, a central body portion 121, and an ear canal main body 131. The ear canal main body 131 of the earphone 101 has flexibility to conform to the ear anatomy. The alternative embodiment shown in FIG. 5 has more then one tab, i.e., three tabs 111*a*, 111*b*, and 111*c*. This allows one ear bud earphone to be used for a range of ear sizes, that is, anti-helix sizes.

A single length for the tab was not good enough to fit the full range of small to large ear size. In the embodiment shown in FIG. 5, there are additional tabs to take care of this. One is shown as slightly shorter than the original and one is shown as slightly longer. If a small eared person uses the product, only the shortest tab will pop under the anti-helix and the others will remain on the outside. As the ear size gets larger, two and then eventually all three tabs will pop under the anti-helix. The flexibility of the tabs takes up the variations in between.

Figure 3:
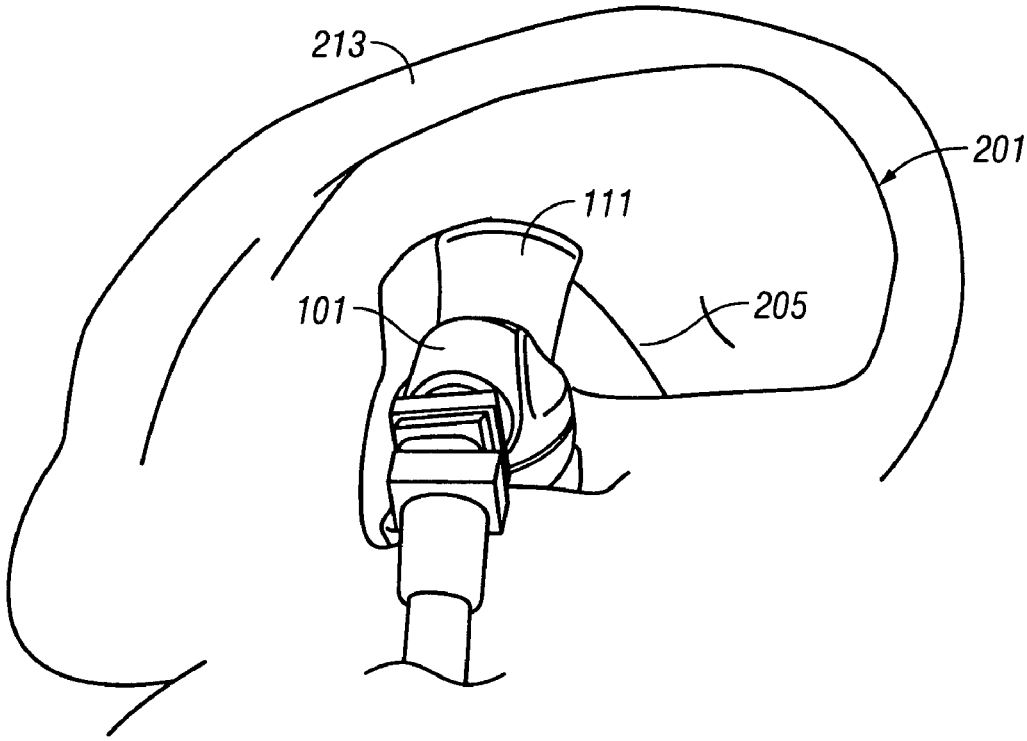
FIG. 3 is an illustration of an ear bud earphone of the invention showing the ear bud earphone and the ear anatomy.

FIG. 3 is an illustration of an ear bud earphone of the invention showing the ear bud earphone and the ear anatomy where the tab 111 of the earphone 101 rests on or under the anti-helix 205 of the user's ear 201.

Figure 4:
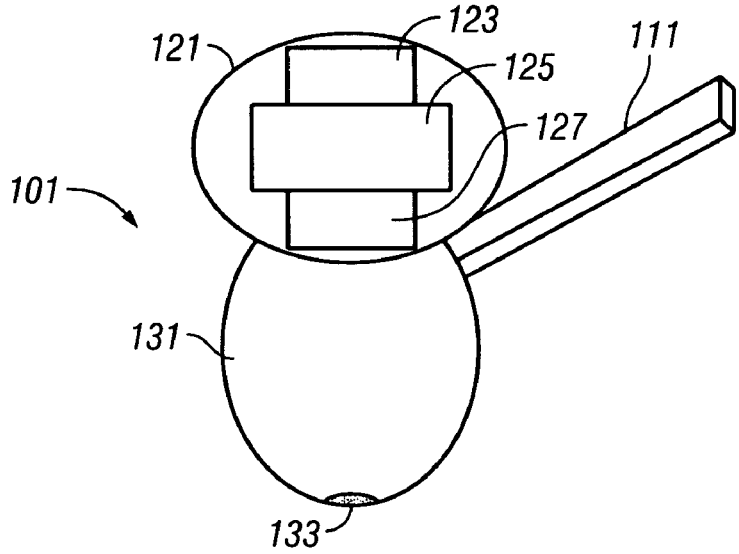
FIG. 4 is an illustration of a specific embodiment of the invention where the ear bud earphone includes a prosthetic (hearing aid).

A hearing aid specific embodiment is illustrated in FIG. 4. The hearing aid ear bud earphone 101 as shown in FIG. 4 has an outer portion 121, a microphone 123, circuit elements 125 including suitable amplifiers and filters, a speaker 127, and an ear canal main body 131 with an acoustic outlet 133 to the ear. The ear canal main body 131 of the earphone 101 has flexibility to conform to the ear anatomy and provide an acoustic seal to block outside acoustic interference.

The following examples of dimensions for ear canal portion 131 are provided for illustrative purposes and are not intended to be limiting. In some embodiments, ear canal portion 131 can have a diameter of about 0.35 to about 0.65 inches and an axial length between its surfaces of about 0.15 to about 0.65 inches. Opening 133 may have a diameter of about 0.08 to about 0.19 inches.

The primary element is a flexible tab, i.e., a tab 111 made from an elastomeric material or foam protruding from the main body 121, 123, 131 of the ear bud headphone in a plane generally perpendicular to the ear canal and the longitudinal axis of the ear bud earphone. Where a microphone boom or a cord is present, the tab may be substantially directly opposite the microphone boom and/or cord.

This tab 111 is generally parallel to the pinna 201 engaging at or under the anti-helix 205 and acts to hold the ear bud speaker against or even within the ear canal entrance 209 to maintain a seal and stabilize any movement of the ear bud speaker (including the associated headset or headphone assembly). The tab 111 may be at a slight upward angle (away from the pinna 201 and ear lobe 209) so that as it pushes off of the under side of the anti-helix 205, it exerts a force down and forward on the ear lobe 209. Because the tab 111 is flexible, it easily adjusts to different ear sizes.

Auditory Isolation

It is known that isolating an ear from other sounds (i.e., sounds not originating from the sound device) allows the user to better process sound coming from the sound device, even when the device is only in one ear with the other ear receiving extraneous and environmental sounds. This allows the user to better distinguish the sounds from the sound device from other sounds that could be distracting. This feature may be particularly useful when the sound device is an ear bud connected to a telephone because the user would be able to adequately hear and distinguish voices from the telephone from other sounds or voices that might be present in the area. This feature also reduces the likelihood that sounds originating from the sound device would be confused with extraneous sounds, even when the user's other ear does not have any sound device disposed therein. Moreover, by reducing the amount of unwanted sound that enters the ear, a lesser degree of energy can be delivered to the eardrum for the same level of sound perception and intelligibility. This can protect the eardrum from damage that could be caused by exposure to greater amounts of energy or otherwise help preserve or enhance the long-term health of the ear.

An in-the-ear hearing aid is used by inserting the hearing aid into the entrance of the ear canal and concha as shown in FIGURES. The hearing aid has an outer end on which are located the various devices necessary to control and maintain the hearing aid, i.e., the volume adjustment mechanism which is internally connected to internal transducer, filter, and amplifier circuitry to raise and lower the gain and adjust the frequency response of the hearing aid. An access panel opens to permit access to a battery for replacement purposes. A microphone collects sound waves and converts them into electrical signals for amplification on the interior of the hearing aid.

As illustrated in FIG. 4, a hearing aid is shaped to generally conform to the shape of the anti-helix 205 and the opening of the concha 207. Persons with larger ears, that is, greater anti-helix diameters and concha diameters, are fitted with larger hearing aids. However, no two conchas and no two ear canals are shaped exactly alike. This implies that there can never be a "perfect match" between the shape of the standard hearing aid and the shape of any individual's concha. Thus, in the absence of custom molding and shaping, which is very time consuming and expensive, there will usually be one or more audio "short circuit" gaps from the inner portion of the ear canal, along the hearing aid body, to the exterior of the ear in the vicinity of the hearing aid microphone.

Acoustic energy from a remote source energizes the hearing aid microphone. The acoustic energy is converted to electrical energy by a transducer, and is input to an amplifier and filter bank within the hearing aid where it may be greatly amplified and filtered (as band pass filtered and band stop filtered) and provided to a speaker located inside the small end of the hearing aid.

The amplified sound waves enter the ear canal and travel to the eardrum. But the sound waves also travel back through audio "short circuit" gaps between the walls of concha and the walls of the hearing aid. Some of the acoustic energy exiting along the short circuit may then be collected by the microphone. If the amplitude of the acoustic energy reentering microphone is sufficiently high a classic self sustaining feedback situation arises. The input to the microphone is increased (by the reentering sound from the acoustic short circuit) resulting in increased output volume. The output volume thus quickly increases to the point where a screeching high volume, painful signal is broadcast to the wearer's eardrum and interferes with speech discrimination Feedback is only one of a number of problems that affect users of hearing aids. Because the hearing aid generally conforms to the shape of the concha which has an entrance larger than its inner/bottom end, the hearing aid can easily work its way out of the concha. Perspiration and ear wax serve to lubricate the surfaces of both the concha and the hearing aid. Any slight muscle movement around the concha, such as caused by prolonged talking, yawning, grinding teeth or eating, may easily dislodge the hearing aid and move it outward from its proper position for most effective operation. As the hearing aid moves outward, small clear passageways, that is, acoustic short circuit channels or pathways are produced and feedback occurs. This results in the user having to repeatedly reseat the hearing aid in the ear or decrease the gain of the hearing aid in order to avoid feedback. But by decreasing the gain, the user's hearing ability is decreased. Also if the hearing aid becomes sufficiently loose, it may fall out and be damaged or lost.

Communications headsets have a similar problem when a short boom is used and the microphone is mounted close to the speaker. Sound leaking from the speaker into the microphone is unintentionally sent to the far end appearing as an echo.

The tab 111, providing a surface to apply pressure to the ear bud upon insertion, and to easily grasp the earphone for removal, enable a tight seal to be formed between the earphone and the ear structure.

Materials of Construction.

Effective retention of the ear bud earphone in the user's ear canal involves interactions between the earphone 101 and the ear anatomy 207. These interactions include, e.g., the lubricity of ear tissue and ear bud insert, mucus, ear wax, the surface tensions between the ear anatomy 207 and the ear canal portion 131 of the earphone 101, and the flexibility and deformation of ear anatomy 207 and ear canal portion 131 of the ear bud headset 101.

Comfort, ease of insertion and removal can be enhanced by judicious choice of the materials of construction.

The materials used to manufacture ear canal portion 131 may vary. In some embodiments, ear canal portion 131 is made from a polymer. Because a number of polymers are relatively inexpensive, constructing ear canal portion 131 from a polymer may desirably impact the manufacturing costs. In addition, because of the relatively low manufacturing costs that are contemplated, ear canal portion 131 may be inexpensive for the consumer and disposable. Some examples of suitable polymers may include ethylene tetrafluoroethylene (ETFE), fluorinated ethylene propylene (FEP), polyoxymethylene (POM), polybutylene terephthalate (PBT), polyether block ester, polyurethane, polypropylene (PP), polyvinylchloride (PVC), polyetherester, polyester, polyamide, elastomeric polyamides, block polyamide/ethers, polyether block amide, silicones, polyethylene (PE), Marlex high-density polyethylene, Marlex lowdensity polyethylene, linear low density polyethylene, polyethylene terephthalate (PET), polyetheretherketone (PEEK), polyimide (PI), polyetherimide (PEI), polyphenylene sulfide (PPS), polyphenylene oxide (PPO), polysulfone, nylon, perfluoro(propyl vinyl ether) (PFA), other suitable materials, or mixtures, combinations, copolymers thereof, polymer/metal composites, and the like.

The tab 111 may be fabricated of the same material as the remainder as the earbud earphone 101 or of another compatible material, where compatibility means both fabrication compatibility and biological compatibility with the user.

The ear bud speaker headphone 101 described herein may be an element of a telephone, a radio receiver, a two way radio, a sound system (as an MP3 system), a hearing aid, or a sound blocking ear plug.

It should be understood that this disclosure is, in many respects, only illustrative. Changes may be made in details, particularly in matters of shape, size, and arrangement of steps without exceeding the scope of the invention. The invention's scope is, of course, defined in the language in which the appended claims are expressed.

I claim:

1. An ear bud earphone adapted for insertion in a user's ear, said ear bud earphone comprising two or more tabs extending from the ear bud earphone, said tabs being substantially orthogonal to a longitudinal axis of the ear canal wherein the tabs are adapted to engage the anti-helix of the ear.

2. The ear bud earphone of claim 1 wherein the tabs are at an upward angle from orthogonal to the longitudinal axis, away from the ear tip whereby as the ear bud earphone is removed the ear bud earphone tabs push off of the under side of the anti-helix, exerting a force down and forward on the ear tip.

3. The ear bud earphone of claim 1 having an ear canal portion for insertion into a user's ear canal.

4. The ear bud earphone of claim 1 wherein the tabs are of different lengths.

5. The ear bud earphone of claim 4 wherein the tabs are flexible and fit sequentially under an anti-helix of a user's ear depending on the size of the user's ear.

6. The ear bud earphone of claim 1, the ear bud earphone adapted to function as a hearing aid and comprising a microphone, an acoustic outlet, an ear canal portion for insertion into a user's ear canal, and an amplifier and filter circuit between the microphone and the acoustic outlet.

7. The ear bud earphone hearing aid of claim 6, said ear canal portion of the ear bud earphone forming a seal with a user's ear canal when inserted therein.

8. An ear bud earphone hearing aid adapted for insertion in a user's ear canal, said ear bud earphone comprising two or more tabs extending from the ear bud earphone, the tabs being substantially orthogonal to a longitudinal axis of the ear canal, wherein the tabs are adapted to engage the anti-helix of the ear an ear canal portion for insertion into a user's ear canal, the ear bud earphone hearing aid comprising a microphone, an acoustic outlet, and an amplifier and filter circuit between the microphone and the acoustic outlet.

9. The ear bud earphone hearing aid of claim 8 wherein the tabs are of different lengths.

10. The ear bud earphone hearing aid of claim 9 wherein the tabs are flexible and fit sequentially under an anti-helix of a user's ear depending on the size of the user's ear.

11. A voice communications system having an ear bud earphone adapted for insertion in a user's ear, said ear bud earphone comprising two or more tabs extending from the ear bud earphone, said tabs being substantially orthogonal to a longitudinal axis of the ear canal wherein the tabs are adapted to engage the anti-helix of the ear.

12. The voice communications system of claim 11 wherein the tabs are at an upward angle from orthogonal away from the ear lobe whereby as ear bud earphone is removed the ear bud earphone tabs push off of the under side of the anti-helix, exerting a force down and forward on the ear tip.

13. The voice communications system of claim 11 wherein the tabs are of different lengths.

14. The voice communications system of claim 13 wherein the tabs are flexible and fit sequentially under an anti-helix of a user's ear depending on the size of the user's ear.

15. The voice communications system of claim 14, further comprising an ear canal portion that forms a seal with a user's ear canal when inserted therein.

16. The voice communications systems of claim 11 wherein the input to the ear bud earphone is an acoustic input.

17. The voice communications system of claim 11 wherein the input to the ear bud earphone is an electrical input.

* * * * *